US005167277A

United States Patent [19]

Evans

[11] Patent Number: 5,167,277

[45] Date of Patent: Dec. 1, 1992

[54] WELL SERVICE CONTAINMENT SYSTEM

[75] Inventor: Vlanton R. Evans, Crane, Tex.

[73] Assignee: Atlantic Richfield Company, Los Angeles, Calif.

[21] Appl. No.: 783,741

[22] Filed: Oct. 28, 1991

[51] Int. Cl.[5] ..... E21B 33/08

[52] U.S. Cl. ..... 166/81

[58] Field of Search ..... 166/81, 75.1, 379

[56] References Cited

U.S. PATENT DOCUMENTS

| | | | |
|---|---|---|---|
| 113,638 | 4/1871 | Dewey | 166/81 |
| 1,357,856 | 11/1920 | Edgecomb | 166/81 |
| 1,507,628 | 9/1924 | Schluyler | 166/84 |
| 4,673,034 | 6/1987 | Hansen | 166/81 X |
| 4,949,784 | 8/1990 | Evans | 166/81 |
| 5,121,794 | 6/1992 | Hibdon et al. | 166/81 |
| 5,121,796 | 6/1992 | Wigington, Jr. | 166/379 |

*Primary Examiner*—Hoang C. Dang

*Attorney, Agent, or Firm*—Roderick W. MacDonald

[57] ABSTRACT

A fluid spill deflection system and device for use with a wellhead or attachment thereto comprising a flexible sheet-like member having a first aperture for fitting about the wellhead or attachment thereto, a drain, and fastening devices fixed to the member for supporting the member about the wellhead or attachment thereto.

9 Claims, 3 Drawing Sheets

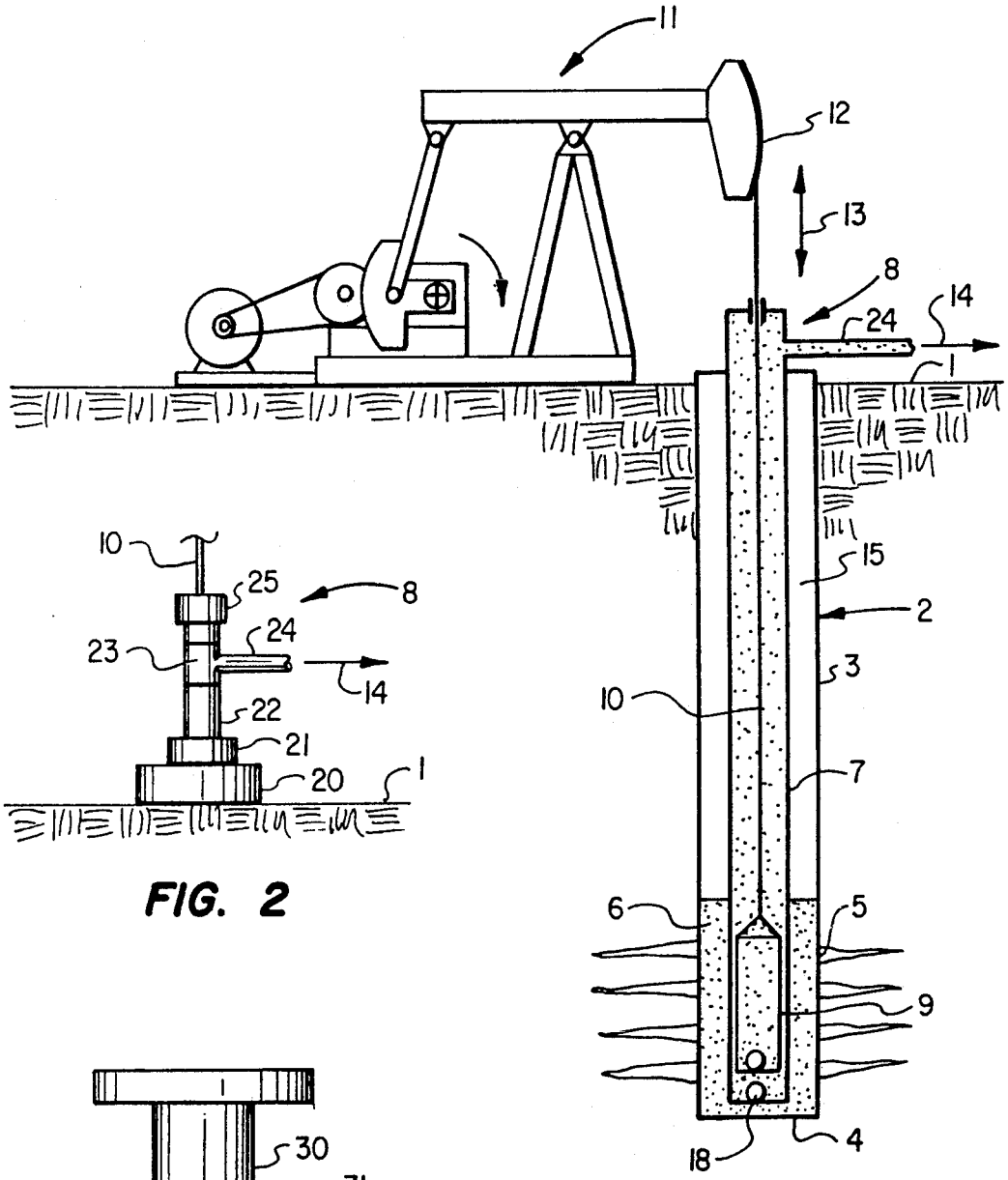
FIG. 1
FIG. 2
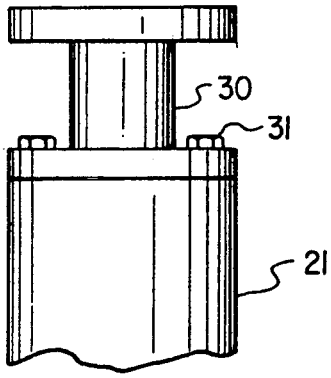
FIG. 3

WELL SERVICE CONTAINMENT SYSTEM

BACKGROUND OF THE INVENTION

A well is drilled into the earth to reach subsurface geologic formation(s) from which oil, gas, water, or other minerals can be produced to the earth's surface. Often the minerals have to be artificially lifted or otherwise pumped from inside the wellbore to the earth's surface. In the normal maintenance of the well, the pipe and other apparatus associated therewith both in the wellbore and at the earth's surface are removed for replacement, repair, or other maintenance work. This is called a "workover" of a well. The apparatus employed to work over a well is often called a pulling unit because it is used to pull pipe and other equipment out of the wellbore for maintenance.

Sometimes during a workover fluids in the wellbore necessarily come out of the wellbore with the apparatus being removed therefrom and must be disposed of in an environmentally acceptable manner rather than letting them spill onto the earth's surface around the well.

Accordingly, it is desirable to have a spill containment system which can be employed during workover or any other type of well service project.

Since wells can be widely spaced apart over a very large area, a normal pulling unit is very mobil and self-contained. Therefore, it is also desirable that a well service spill containment system be highly portable, compact, and easily deployed by a small number of personnel.

Accordingly, it is an object of this invention to provide a new and improved well service spill containment system. It is another object to provide a fluid spill deflection device for use with a mobil pulling unit during a well workover.

Other aspects, objects and advantages of this invention will be apparent to those skilled in the art from this disclosure and the appended claims.

DESCRIPTION OF THE DRAWINGS

FIG. 1 shows a cross-section of a well extending into the earth and a conventional pumping unit at the surface of the earth.

FIG. 2 shows a conventional wellhead configuration which a pulling unit, is used to workover.

FIG. 3 shows the wellhead of FIG. 2 with a spacer spool in place thereon in preparation for a workover operation.

DETAILED DESCRIPTION

Figure 4:
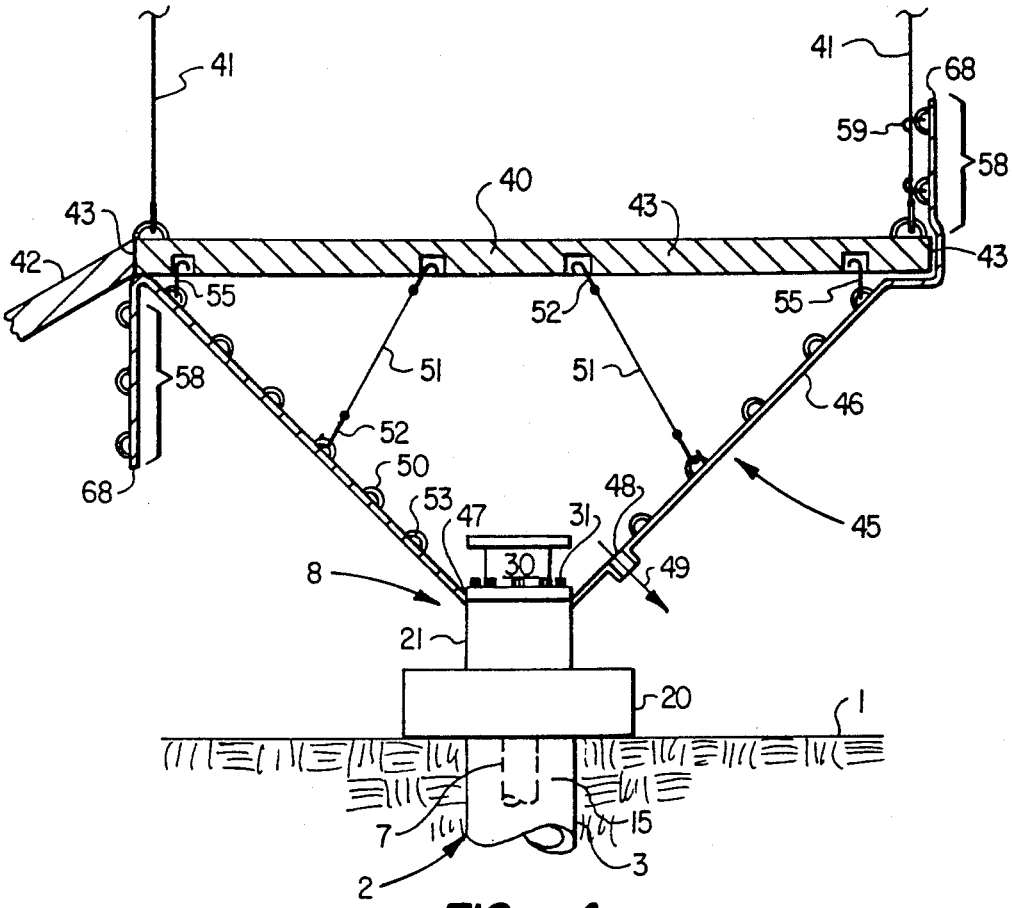
FIG. 4 shows the apparatus of FIG. 3 with the spill containment system of this invention in place below the work floor of the pulling unit.

FIG. 1 shows the earth's surface 1 having a wellbore 2 extending downwardly there into to the vicinity of one or more mineral producing subsurface geologic formations. Wellbore 2 can be lined with steel casing 3 which extends to the bottom 4 of wellbore 2 and is perforated a plurality of times at 5 so as to allow mineral fluids to flow from one or more subsurface formations (not shown) through casing 3 into the bottom portion of wellbore 3 and to collect therein as shown at 6. Production tubing 7 extends from wellhead 8 at the earth's surface down into produced fluid 6. Fluid 6 is admitted to the interior of tubing 7 by way of one-way valve means 18 which works in cooperation with the reciprocation of associated downhole reciprocating pump means 9. Pump 9 is carried by sucker rod string 10 which in turn is connected to a conventional pumping unit 11 which reciprocates horsehead 12 as shown by arrows 13 thereby reciprocating sucker rod string 10 and pump 9 to force fluid 6 up the interior of tubing 7 and out of wellhead 8 through pipe 24 as shown by arrow 14 for collection, treatment, or other disposition as desired on the earth's surface.

In a normal workover operation, horsehead 12 is removed and a pulling unit moved in over the top of wellhead 8. A removable work floor carried by the pulling unit is placed over wellhead 8 below the area where horsehead 12 is normally located so that the workover personnel can operate directly over the top of wellhead 8 to remove one or more of sucker rod string 10, pump means 9, tubing 7, and even casing 3 as necessary. The removal of one or more of the foregoing apparatus from wellbore 2 necessarily brings produced fluid 6 to the earth's surface with the removed apparatus which if not contained will flow down onto earth's surface 1 around and in the vicinity of wellhead 8 and pumping unit 11 thereby undesirably contaminating that portion of the earth's surface. The spill containment system and fluid spill deflection device of this invention are designed to prevent such a result by catching and collecting produced fluid 6 that falls on floor 40 (FIG. 3), flows down around wellhead 8, or the like during workover and for removing such collected fluid to a collection pit or tank or even reintroducing such fluid back into the wellbore, for example, into annulus 15 between the exterior of tubing 7 and interior of casing 3.

FIG. 2 shows a conventional wellhead 8 comprising casing head 20 which supports casing 3, tubing ring 21 which supports tubing string 7, upstanding pipe conduit 22 which carries a Tee 23 with pipe 24 extending therefrom for the removal of produced fluid from the wellhead as shown by arrow 14. Wellhead 8 is capped with a stuffing box 25 through which passes sucker rod string 10, i.e., the polished rod portion of string 10, so that string 10 can reciprocate through stuffing box 25 without liquid loss from the interior of wellhead 8.

In a normal workover a portion of the wellhead is removed, for example, elements 22 through 25, thereby leaving a lower portion of wellhead 8 from which to carry out workover operations, e.g., tubing ring 21. Sometimes an attachment is fixed to the lower part of wellhead 8 that remains for the workover operation.

This attachment can for example, be either a blowout preventer in the situation where annulus 15 has some pressure remaining therein or simply a spacer spool which is merely a working surface from which to carry out workover operations.

FIG. 3 shows a portion of wellhead 8 left for the workover operation, in this example tubing ring 21, with a conventional spacer spool 30 fixed by means of bolts 31 to tubing ring 21. Spacer spool 30 merely provides a working platform on which the workover crew can rest the slips which they use to remove tubing string 7 from wellbore 2 in a conventional manner. Accordingly, element 21 represents wellhead 8 and element 30 represents attachment to wellhead 8. Other attachments can be carried by wellhead 8 during workover such as a blowout preventer which placed on wellhead 8 before spacer spool 30, spacer spool 30 being placed on top of the blowout preventer. Other attachments can be employed such as a tubing stripper which is fixed above spacer spool 30 to isolate annulus 15 when that annulus remains under pressure during the workover operation. Accordingly, this invention is useful with wellhead 8 and/or any attachment that may be employed therewith depending upon the particular workover operations being employed. This invention is applicable then to all well service operations such as pulling the sucker rod string and/or tubing string with or without a blowout preventer or for specific applications such as where a blowout preventer is placed on top of the wellhead and the tubing string 7 is pulled out of the well through the blowout preventer.

FIG. 4 shows wellhead 8 stripped down to tubing ring 21 with spacer spool 30 in place thereon for commencement of workover operations. During such operations a removable work floor 40 is placed over the top of wellhead 8 and supported by a plurality of guy wires 41. A walk-up access ramp 42 is connected to one of the defined outer edges 43 of work floor 40. Work floor 40 is supported by connecting guy wires 41 to the pulling unit (not shown) which is moved adjacent to wellhead 8 for the workover operation.

FIG. 4 shows the well service spill containment system of this invention to be composed of a fluid spill deflection device 45 which is comprised of a flat flexible sheet-like member 46 having a first aperture 47 for fitting about wellhead 8 or an attachment thereto, and a second drain aperture 48 for removing liquid collected by member 46 which runs out of the top of spacer spool 30 or falls off of equipment being removed from wellbore 2 or which otherwise is spilled on working floor 40 and falls through perforations in that floor. All such fluids collect around spool 30 for removal in an environmentally acceptable manner by way of aperture 48 as shown by arrow 49.

The fluid spill deflection device of this invention also carries a plurality of fastening means 50 which are fixed to member 46 and adapted to receive separate means for supporting member 46 about wellhead 8 and below floor 40. Any type of support means is useful with this invention such as rubber stretch ties 51 with metal hooks 52 for passing through both eyes 53 in fastening means 50 and openings in the expanded steel of work floor 40. Similar metal hooks without rubber ties 55 can be employed to support member 46 close to floor 40 in or near the vicinity of defined outer edges 43 of floor 40.

Member 46 is fastened to a section wellhead 8 such as tubing ring 21 or is fastened to spool 30 or any other attachment to wellhead 8, all in a liquid tight manner.

Generally, member 46 is made to be of an area, when lying flat, so that when connected to wellhead 8 or an attachment thereto as shown in FIG. 4 by means of aperture 47, member 46 extends from the vicinity of wellhead 8 at least up to the vicinity of defined outer edges 43. The area covered by member 46 can be such that when connected to wellhead 8 or an attachment thereto member 46 approaches but does not reach defined outer edges 43 or, in the alternative, extends to defined outer edges 43 and beyond those outer edges so that portions 58 of member 46 extend beyond outer edges 43. Excess portions 58 can be employed singularly or in combination with two or more thereof as a wind screen for floor 40 by raising them above work floor 40 and fixing them to guy wires 41 with hook means 59. This provides a means by which wind borne or otherwise sprayed fugitive liquids at working floor 40 are still caught by member 40 for collection in the vicinity of spool 30 rather than blown off of work floor 46 and deposited on earth's surface 1. In deploying wind screens 58 care must be taken to provide adequate ventilation and emergency egress for workers from floor 40. For example, three wind walls could be employed with no wall on the up-wind side where ramp 42 is employed.

Member 46 is preferably a low cost, light weight, exceedingly flexible sheet-like material which is strong enough for reuse, resistent to normal tool droppage from floor 40, and also resistent to deterioration caused by sun, weather, or contact with material produced from wellbore 2 and/or used in the workover process itself. For example, member 46 could be rubberized canvas or a rubber sheet itself. It could be a flexible plastic such a polyvinyl chloride, polyethylene, or polypropylene. It could also be a laminate composed of two or more plastic, rubbery or other layers. The thickness of member 46 would vary depending upon its composition and the combination of materials if a laminate, but would generally be in the 10–20 mil range in order to meet the lightweight, flexibility, and portability requirements. For example, it is preferable that member 46 roll or otherwise fold up into a small volume unit for compact storage, maximum portability, and ease of installation of no more than two personnel. In the case of an oil an-d, gas well workover, member 46 must be resistent to all forms of hydrocarbons.

Liquid removed through aperture 48 can be conducted by way of a conventional, electrically grounded pipe, hose, or the like to an existing collection pit, tank or the like. A collapsible tank with a capacity of up to, for example, 30 barrels (42 gallons per barrel) could be carried on the pulling unit along with the fluid spill deflection device of this invention. Even larger collapsible tanks of up to 100 barrel capacity can be employed if necessary when pulling tubing 7 from a well. Alternatively, when conditions permit fluid removed through aperture 48 can be returned to the interior of wellbore 2 e.g., annulus 15.

Figure 5:
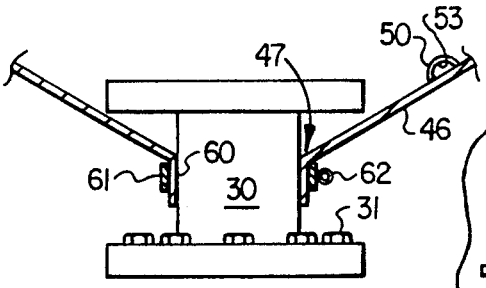
FIG. 5 shows one embodiment within this invention for attaching the fluid spill deflection device of this invention to the wellhead or an attachment thereto.

Member 46 can be fixed to wellhead 8 or any attachment thereto in any manner desired so long as a liquid tight seal is achieved. For example, FIG. 5 shows one of the simplest approaches wherein aperture 47 is occupied by spool 30 and edge 60 of member 46 which defines aperture 47 abuts spool 30 and is fixed thereto by a conventional hose clamp 61 with it associated screw tightening device 62. If desired, edge section 60 can be thickened so as to be substantially thicker for wear resistent purposes than the normal thickness of member 46. Edge 60 can also, or in the alternative, be elasticized so that it will snugly fit around and grip spool 30 even without the use of hose clamp 61. A conventional draw string (not shown) could also be embodied in edge 60 in lieu of or along with hose clamp 61 and/or an elastic section.

Figure 6:
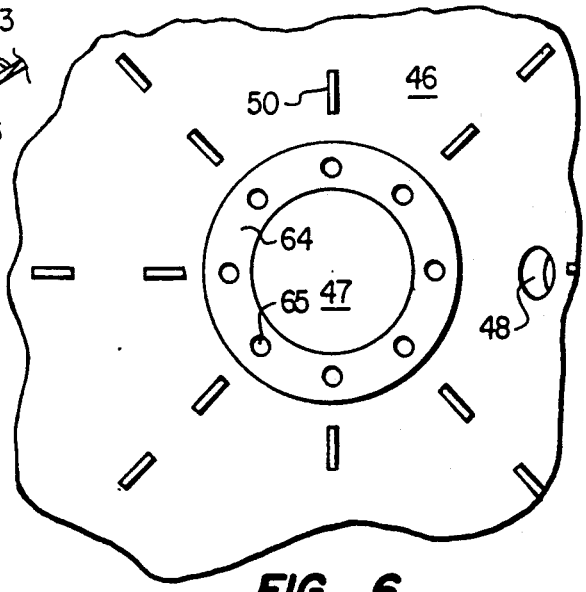
FIG. 6 shows a top view of a central portion of the deflection device of this invention.

FIG. 6 shows the top view of the center portion of member 46 with apertures 47 and 48 and wherein a rigid or semi-rigid ring 64 defines aperture 47 and is fixed to edge 60 of member 46. Ring 64 is designed to fit, for example, between tubing ring 21 and spool 30 and has a series of bolt holes 65 therein which matches with the bolt pattern for bolts 31 which normally fix spool 30 to ring 21.

Figure 7:
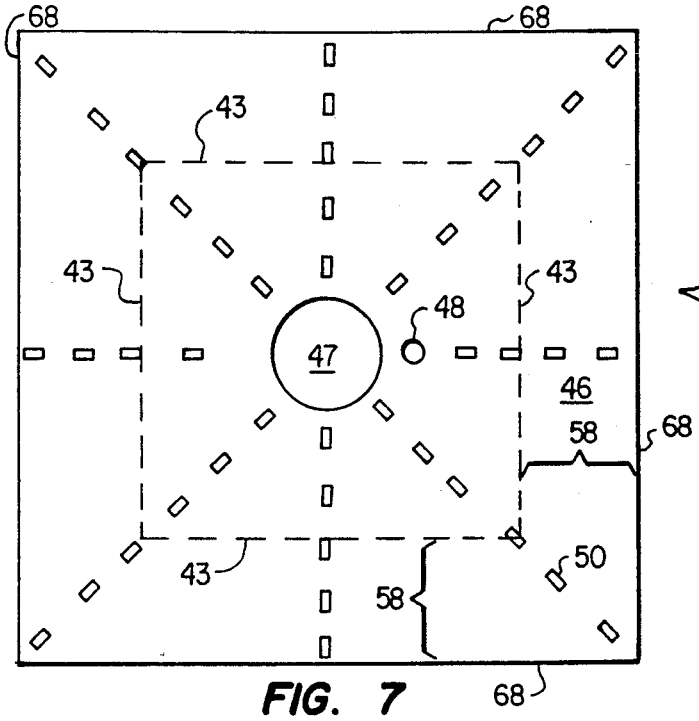
FIG. 7 shows a top view of the full extent of a spill deflection device within this invention.

FIG. 7 shows the top view of member 46 when laid flat and shows that means 50 for supporting member 46 beneath work floor 40 is in actuality a plurality of spaced-apart individual fastening means 50. Means 50 can be, for example, a series of eyes fixed to one side of member 46 and spread out over essentially all of that one side in any type of desired pattern to provide a plurality of locations whereby a plurality of separate support means 51 and 55 can be connected to fastening means 50 and to work floor 40 to obtain the desired funnel-like configuration for the spill deflection device of this invention as shown in FIG. 4.

The spill deflection device of this invention is composed then of member 46 and a plurality of fastening means 50 together with apertures 47 and 48. The spill containment system of this invention is the foregoing device in combination with any type of support means such elements 51 and 55 and Work floor 40. It should be noted that the support means useful for supporting member 46 in the configuration shown in FIG. 4 need not be connected to floor 40 but could actually also be disposed beneath member 46 as a frame, a series of individual upright tent poles, or as any other conventional ground based support system for member 46, all types of support means for disposing member 46 in the configuration shown in FIG. 4 being useful in this invention.

FIG. 7 also shows that the area of member 46 when spread out flat can be larger than the area of working floor 40 as represented by dotted lines 43 which represent the defined outer edges of working floor 40. This way, when member 46 is supported in the conical configuration of FIG. 4, outer edges 68 of member 46 reach at least to the vicinity of defined outer edges 43 and, preferably, beyond as shown in FIG. 4.

Figure 8:
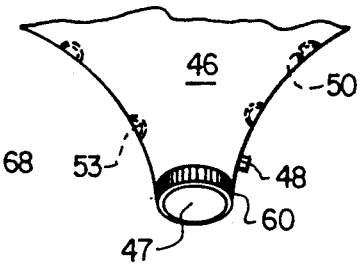
FIG. 8 shows a portion of a spill deflection device within this invention.

FIG. 8 shows one embodiment within this invention wherein thickened section 60 of member 46 is tailored to have a rounded configuration which better conforms to the external configuration of the wellhead or other attachment thereto and about which section 60 is to be placed in a liquid tight manner. It is this section 60 that can be elasticized or otherwise rubberized so that it can stretch out around the wellhead or its attachment and then on its own pull tightly against the outer surface thereof even without the use of an artificial and separate tightening means such as a hose clamp or a drawn string. In any event, FIG. 8 shows that member 46 can be shaped, at least in the vicinity of aperture 47, so as to be predisposed to conform to the configuration shown in FIG. 4 when the entire member is supported below work floor 40 and is not limited simply to a flat sheet with a hole cut in the middle.

Figure 9:
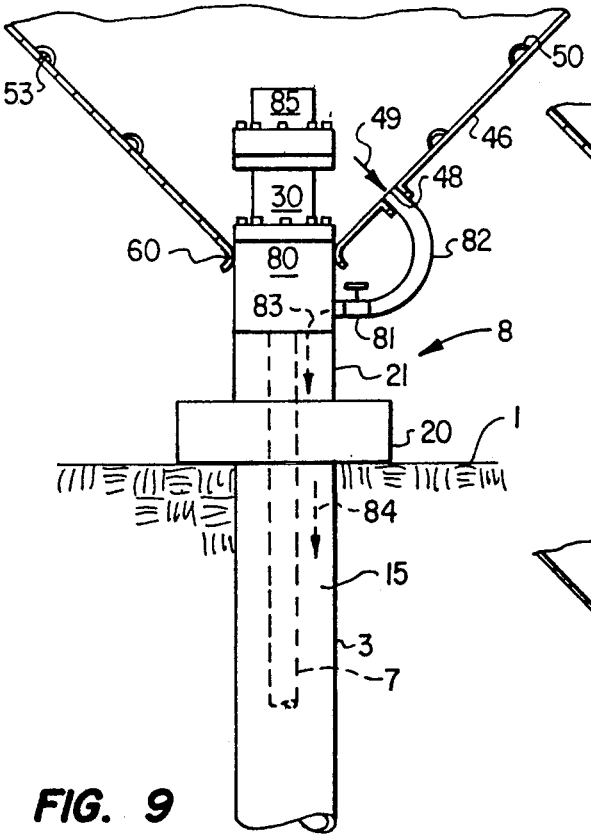
FIG. 9 shows yet other embodiment within this invention wherein the wellhead is surmounted by a blowout preventer and the spill containment system of this invention fixed to the blowout preventer.

FIG. 9 shows an embodiment with this invention wherein wellhead 8 has a blowout preventer 80 fixed thereto, for example, to tubing ring 21. In such a situation it is preferred that section 60 of member 46 be located at or near the upper portion of blowout preventer 80 in order to leave the standard valved connection 81 on blowout preventer 80 open to access. This way conduit means 82 can be connected to valve 81 so that liquid collected by member 46 can be drained through aperture 48, conduit 82, and valve 81 directly back into annulus 15 as shown by arrows 49, 83 and 84 for immediate disposal of such collected fluid. If blowout preventer 80 is not employed, collected liquid can still be drained directly into annulus 15 at tubing ring 21. Accordingly, member 46 can be fixed to the outer surfaces of blowout preventer 80 or spacer spool 30 or even optional tubing stripper 85 which can also be used if annulus 15 is under pressure. Alternatively, section 60 of member 46 or a device attached thereto such as ring 64 of FIG. 6 can be fitted into the interface between blowout preventer 80 and spacer spool 30 or between the interface between spool 30 and tubing stripper 85 as discussed hereinabove with reference to FIG. 6 and as will be described in greater detail with reference to FIGS. 10 and 11.

Figure 10:
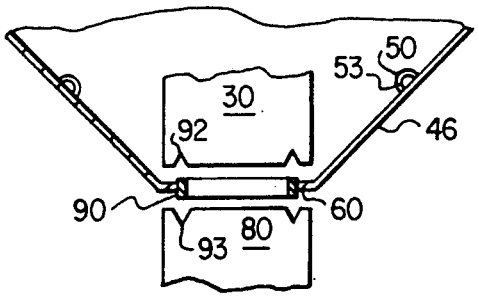
FIG. 10 shows yet another means by which the spill deflection device of this invention can be fixed in a liquid tight manner to a wellhead or associated blowout preventer.

One example for fitting section 60 of member 46 between the interface of two pieces of apparatus is demonstrated in FIG. 10 wherein section 60 is shown to be integrally molded or otherwise bonded to reusable gasket 90. Gasket 90 can be a standard metal gasket or a more pliable reusable gasket conventionally known as a petro-mex gasket which can be used between devices such as blowout preventer 80 and spool 30 a number of times before wearing out. An annular depression 92 is normally machined into the bottom side of spool 30 and a matching annular depression 93 is normally machined into the upper surface of blowout preventer 80 so that depressions 92 and 93 mate to form a groove to receive gasket 90 thereby providing a liquid tight seal when spool 30 is bolted to blowout preventer 80 in the normal manner.

Figure 11:
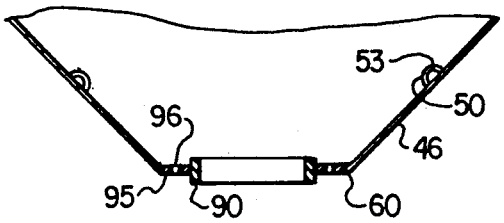
FIG. 11 shows yet another embodiment for fixing the spill deflection device of this invention to a wellhead and/or an attachment thereto in a liquid tight manner.

Another embodiment within the interfacing aspect of this invention is shown in FIG. 11 wherein, instead of bonding section 60 to gasket 90, section 60 is instead bonded to a flat plate 95 which in turn is bonded to gasket 90. Flange 95 has therein a plurality of bolt holes 96 which are drilled to match the bolt pattern of the existing bolts which are employed to fix spool 30 to blowout preventer 80. Section 60 could instead be bonded to a conventional wiper plate used in workovers to prevent dropping bolts or other materials into annulus 15 when that annulus is exposed by removing the wellhead down to tubing ring 21. Thus, element 90 in FIGS. 10 and 11 can be replaced by a conventional wiper plate or any other device normally used at an interface between two pieces of equipment employed on the wellhead during workover.

In practice, for example, a 15 mil neoprene sheet of the shape and configuration shown in FIGS. 7 and 8 is employed around the wellhead and supported below the work floor to form the configuration shown in FIG. 4 as a first step. Thereafter, sucker rod string 10 is removed from the well, and following that removal wellhead 8 is broken down to tubing ring 21 or any other subpart of the wellhead necessary for carrying out subsequent workover steps. Then tubing string 7 is removed from the wellbore without the use of a blowout preventer or, if necessary, a blowout preventer is added before the tubing string is removed. In any event it can be seen that a number of operations involving the wellhead and equipment down in the wellbore are all carried out after member 46 is in place under working floor 40 so that all liquids spilled during such operations are caught by member 46 either for return downhole into the wellbore or removal in an environmentally acceptable manner to a collapsible tank or other suitable holding means.

Reasonable variations and modifications are possible within the scope of this disclosure without departing from the spirit and scope of this invention.

What is claimed is:

1. In a system for the workover of a well which extends into the earth and is capped at the earth's surface with a wellhead, said system employing a removable work floor that can be disposed over and spaced above said wellhead during the workover process, said work floor having defined outer edges, the improvement comprising a flexible, sheet-like member which when spread out flat covers an area in relation to the area covered by said work floor so that said member can extend upwardly from the vicinity of said wellhead at least up to the vicinity of said defined outer edges of said work floor, said member having a first aperture therein for fitting about said wellhead or an attachment thereto in a liquid tight manner, said member having a second aperture in the vicinity of said first aperture for removing liquid collected by said member, said member carrying a plurality of spaced apart fastening means over one surface thereof whereby a plurality of support means can be connected to said fastening means and to said work floor when said floor is disposed over said wellhead thereby supporting said member below said work floor, and means for supporting said member beneath said work floor.

2. The apparatus according to claim 1 wherein said member has an area when spread out flat that is at least equal to the area of said work floor.

3. The apparatus according to claim 1 wherein said fastening means are a series of eyes fixed to one side of said member and spread out over essentially all of said one side.

4. The apparatus according to claim 1 wherein said member covers an area such that when connected to said wellhead or an attachment thereto said member extends to the defined outer edges of said work floor in a funnel-like fashion ad extends beyond said defined outer edges so that the portions of said member that extend beyond said defined outer edges can be raised above said work floor to form a wind screen for said work floor.

5. The apparatus according to claim 1 wherein said member covers an area such that when connected to said wellhead or an attachment thereto said member approaches but does not reach said defined outer edges of said work floor.

6. The apparatus according to claim 1 wherein said member is composed of a flexible material having a coating of at least one of a rubberized material or a plastic material.

7. The apparatus according to claim 1 wherein said member is composed of at least one of rubber or plastic.

8. A fluid spill deflection device for use with a wellhead or attachment thereto comprising a flat flexible sheet-like member having a first aperture for fitting about said wellhead or attachment thereto, a second drain aperture therein, and fastening means fixed to said member comprising a plurality of spaced apart fastening means over one surface of said member for receiving separate support means for supporting said member about said wellhead.

9. The apparatus according to claim 8 wherein said fastening means are a series of eyes fixed to one side of said member and spread out in spaced apart fashion over a substantial portion of said one side.

* * * * *